US008252023B2

(12) United States Patent
Moses et al.

(10) Patent No.: US 8,252,023 B2
(45) Date of Patent: Aug. 28, 2012

(54) PACIFIER

(75) Inventors: Allen J. Moses, Chicago, IL (US); Stephen H. Sheldon, Chicago, IL (US)

(73) Assignee: Pacif-Air, LLC, Chicago, IL (US)

( * ) Notice: Subject to any disclaimer, the term of this patent is extended or adjusted under 35 U.S.C. 154(b) by 111 days.

(21) Appl. No.: 12/619,419

(22) Filed: Nov. 16, 2009

(65) Prior Publication Data

US 2010/0063543 A1 Mar. 11, 2010

(51) Int. Cl.
*A61J 17/00* (2006.01)

(52) U.S. Cl. ..... 606/234

(58) Field of Classification Search ..... 606/234, 606/236

See application file for complete search history.

(56) References Cited

U.S. PATENT DOCUMENTS

| | | | | |
|---|---|---|---|---|
| 516,561 | A | 3/1894 | Bosch | |
| 2,520,773 | A | 8/1950 | Muller | |
| 4,105,032 | A | 8/1978 | Blomstedt | |
| 4,304,227 | A | 12/1981 | Samelson | |
| 4,495,945 | A | 1/1985 | Liegner | |
| D300,059 | S | 2/1989 | Pier | |
| 4,986,751 | A | 1/1991 | Bergersen | |
| 5,133,740 | A * | 7/1992 | Kussick | 606/236 |
| D334,064 | S | 3/1993 | Fitzpatrick | |
| 5,259,762 | A | 11/1993 | Farrell | |
| 5,300,089 | A | 4/1994 | Sassin | |
| 5,334,218 | A | 8/1994 | Johnson | |
| 5,666,973 | A | 9/1997 | Walter | |

(Continued)

FOREIGN PATENT DOCUMENTS

DE 38 40 178 A1 5/1990

(Continued)

OTHER PUBLICATIONS

Adair, Steven M., "Pacifier Use in Children: A Review of Recent Literature", p. 449-458, Pediatric Dentistry, 25:5, 2003.

(Continued)

*Primary Examiner* — Kathleen Sonnett
*Assistant Examiner* — Sarah Webb
(74) *Attorney, Agent, or Firm* — McAndrews, Held & Malloy, Ltd.

(57) ABSTRACT

Improved pacifiers are provided. Certain embodiments better accommodate the anatomy of the human oral cavity and throat, and can provide for improved airway patency, healthy jaw development, correct swallowing, and/or satisfy a user's inclination to suck and nibble. Certain embodiments include an upper ridge groove configured to receive a user's upper anterior ridge, and a lower ridge groove configured to receive the user's lower anterior ridge. The ridge grooves can be substantially vertically aligned, can span a user's anterior ridges, and can maintain vertical spacing between the user's anterior ridges. Certain embodiments include an anterior flange and a posterior flange, the upper ridge groove configured to receive the upper anterior ridge between the posterior flange and anterior flange, and the lower ridge groove configured to receive the lower anterior ridge between the posterior flange and anterior flange. Certain embodiments include a nipple projecting substantially vertically from the posterior flange.

11 Claims, 9 Drawing Sheets

U.S. PATENT DOCUMENTS

| | | | | |
|---|---|---|---|---|
| D390,962 | S | 2/1998 | Hohl | |
| 5,814,074 | A | 9/1998 | Branam | |
| 6,080,186 | A * | 6/2000 | Pedersen et al. | 606/234 |
| 6,129,084 | A | 10/2000 | Bergersen | |
| 6,470,200 | B2 | 10/2002 | Walker et al. | |
| D480,147 | S | 9/2003 | Sanbrook et al. | |
| 6,767,357 | B2 | 7/2004 | Uehara et al. | |
| 6,773,451 | B1 | 8/2004 | Dussere | |
| 7,029,491 | B2 | 4/2006 | Davis | |
| 7,144,416 | B2 | 12/2006 | Struckmeier et al. | |
| 7,294,141 | B2 | 11/2007 | Bergersen | |
| 2003/0163162 | A1 | 8/2003 | Uehara et al. | |
| 2003/0176891 | A1 | 9/2003 | Frederic | |
| 2005/0080456 | A1 | 4/2005 | Sanbrook et al. | |
| 2005/0119699 | A1 | 6/2005 | Sari | |
| 2007/0112386 | A1 * | 5/2007 | Branam | 606/234 |
| 2007/0254256 | A1 | 11/2007 | Farrell | |
| 2009/0018582 | A1 | 1/2009 | Ishikawa et al. | |

FOREIGN PATENT DOCUMENTS

| | | | |
|---|---|---|---|
| EP | 0285737 | | 10/1988 |
| FR | 2 792 186 | A1 | 10/2000 |
| WO | WO 99/16405 | A1 | 4/1999 |
| WO | WO 02/064079 | A1 | 8/2002 |

OTHER PUBLICATIONS

Bryk, Nancy E.V., "How Products are Made/Pacifier", enotes, Aug. 30, 2009.

PCT Notification of Transmittal of the International Search Report and the Written Opinion of the International Searching Authority, or the Declaration, in PCT/US2010/055936, dated Feb. 8, 2011.

* cited by examiner

PACIFIER

CROSS-REFERENCE TO RELATED APPLICATIONS/INCORPORATION BY REFERENCE

[Not Applicable]

FEDERALLY SPONSORED RESEARCH OR DEVELOPMENT

[Not Applicable]

MICROFICHE/COPYRIGHT REFERENCE

[Not Applicable]

BACKGROUND OF THE INVENTION

Pacifiers, clinically termed, "non-nutritive sucking devices," are nipple substitutes often made of latex rubber or medical grade silicone. Non-nutritive sucking according to the scientific literature involves two factors, creation of suction to hold the device in the mouth and rhythmic jaw movement (nibbling or chewing).

Pacifiers seem to give an awake baby a sense of well-being and comfort. Pacifiers are held in a baby's mouth in a nursing posture. The artificial nipple is positioned against the roof of the mouth and the tongue placed under the nipple in the floor of the mouth. Infants are often put to bed with a conventional pacifier in their mouth.

Nursing and suckling are associated with pacifiers. The term nurse derives from the Latin word "nutrire," which means, "to nourish." An accepted dictionary definition of the verb nursing is "being fed at the breast." The term suckle derives from the old English, and also refers to a baby being fed from the breast or teat. The neurobiology of nursing and suckling consists of the neural coordination of the biologic activities of milk extrusion, sucking, nibbling, swallowing and breathing.

By genetic design, baby humans suckle at their mother's breast to get nutrition. In contemporary culture, however, babies are commonly fed either infant formula or previously pumped breast milk through an artificial nipple. It is not common that babies are fed on their demand at the mother's breast for the entire first two years of their life. Babies are usually fed on a regular schedule, but babies are not always happy with that schedule.

Contrary to common perception, breast feeding is much more complex than just "sucking." In breast feeding, milk transfer consists of three distinct processes: (1) the baby attaches to the mother's breast by sealing the lips around the breast, the dorsal surface of the tongue pushes the breast to the roof of the mouth and negative pressure of the suction elongates the nipple to approximate the soft palate; (2) rhythmic, positive pressure on the nipple is applied, which is a sort of nibbling movement by the dental ridges (and later the teeth), and is the primary force in releasing milk from the mother's nipple; and (3) positive ductal pressure is applied as a result of the mother's milk ejection reflex.

During breast feeding the baby is simultaneously breathing through the nose, swallowing the milk and not choking. Adults and infants just older than eight months cannot do this. In newborn human babies, whose central nervous system in general is basically quite primitive, this very complex nursing reflex is usually fully developed.

In breast feeding and pacifier use, the main role of suction or negative pressure is to retain the nipple and breast within the baby's mouth. Normal breast feeding is free of frictional movement. If the baby's mouth is sufficiently attached to the mother's breast there is little or no movement of the teat in and out of the baby's mouth. The application of positive rhythmic pressure on the nipple (nibbling) is the main method of milk extrusion in breast feeding.

The perception that bottle feeding only involves suction may, in many cases, also be a misperception. The artificial nipple itself is the determining factor. If the hole in the nipple is too large, as is quite common, the baby's swallowing may be a defense from drowning. When the hole is too large sucking does not occur. If the hole is too small or the nipple is too rigid for the baby to properly constrict it, then nipple compression and sucking result in the milk flowing back into the bottle. It is only with the combination of a properly compliant nipple and the correct hole size in the nipple that suction generated by the baby can be the predominant mechanism for effective milk transfer from bottle to baby.

Pacifiers are commonly thought of as nipple substitutes. Infant pacifiers are technically non-nutritive sucking devices. Pacifiers provide babies with a sense of warmth, security and well-being. With intermittent use during the day non-nutritive sucking devices generally seem to keep babies calm when they would like to feed but it is not on the schedule. Children are often put to sleep with a conventional pacifier in the mouth, especially if they are crying, colicky or otherwise irritable.

Conventional pacifiers may satisfy a baby's inclination for non-nutritive sucking. However, they do not satisfactorily accommodate the anatomy of the human oral cavity and throat, and may not provide preferred positioning for oral development and/or swallowing. Pacifiers that better accommodate the anatomy of the human oral cavity and throat, and/or provide preferred positioning for oral development and/or swallowing, are desirable.

SUMMARY OF THE INVENTION

Improved pacifiers are provided. In certain embodiments, a pacifier includes an upper ridge groove configured to receive a user's upper anterior ridge; and a lower ridge groove configured to receive the user's lower anterior ridge, wherein the upper ridge groove is substantially vertically aligned with the lower ridge groove.

In certain embodiments, the upper ridge groove and lower ridge groove are configured to span only across the user's anterior ridges, and not to span across the user's posterior ridges.

In certain embodiments, the upper ridge groove and the lower ridge groove are configured to maintain a vertical spacing between the upper anterior ridge and the lower anterior ridge. In certain embodiments, the vertical spacing is between about 2 millimeters and about 4 millimeters.

In certain embodiments, the pacifier further includes an anterior flange and a posterior flange, wherein the upper ridge groove is configured to receive the upper anterior ridge between the posterior flange and the anterior flange, and wherein the lower ridge groove is configured to receive the lower anterior ridge between the posterior flange and the anterior flange.

In certain embodiments, the anterior flange and the posterior flange are configured to extend substantially vertically upward toward the upper anterior ridge.

In certain embodiments, the anterior flange and the posterior flange are configured to extend substantially vertically downward toward the lower anterior ridge.

In certain embodiments, the posterior flange includes a tongue groove configured to receive a tip of the user's tongue.

In certain embodiments, the anterior flange is larger than the posterior flange.

In certain embodiments, the anterior flange includes: a first frenum relief groove positioned at a top and toward a center of the anterior flange; and a second frenum relief groove positioned at a bottom and toward the center of the anterior flange.

In certain embodiments, the posterior flange includes: a first papilla/lingual frenum relief groove positioned at a top and toward a center of the posterior flange; and a second papilla/lingual frenum relief groove positioned at a bottom and toward the center of the posterior flange.

In certain embodiments, the anterior flange and the posterior flange comprise rounded edges.

In certain embodiments, the pacifier further includes a nipple projecting substantially vertically from the posterior flange. In certain embodiments, the nipple is configured such that when the user's upper anterior ridge is received in the upper ridge groove, the nipple is forced to deflect from the substantially vertical position and the nipple maintains contact with the roof of the user's mouth.

In certain embodiments, the pacifier further includes a shield comprising an open configuration that can allow air to pass through the shield, the shield structure configured to inhibit the entire shield from entering the user's mouth.

In certain embodiments, the pacifier further includes a stem configured to connect the anterior flange and the shield, the stem configured to provide a space that can accommodate the user's lips between the anterior flange and the shield.

In certain embodiments, the pacifier further includes an air hole configured to pass through the posterior flange, through an arch space between the posterior flange and the anterior flange and through the anterior flange. In certain embodiments, the air hole is about 1 millimeter high and about 3 millimeters wide.

In certain embodiments, the pacifier further includes a handle.

In certain embodiments, the pacifier further includes a ring attached to the handle.

In certain embodiments, the positioning of the user's upper anterior ridge in the upper ridge groove, and the user's lower anterior ridge in the lower ridge groove provides for improved airway patency, such that the user's airway is larger than when the user's jaw is in a normal resting position.

In certain embodiments, the positioning of the user's upper anterior ridge in the upper ridge groove, and the user's lower anterior ridge in the lower ridge groove provides for healthy jaw development.

In certain embodiments, the positioning of the user's upper anterior ridge in the upper ridge groove, and the user's lower anterior ridge in the lower ridge groove provides for correct swallowing.

In certain embodiments, the pacifier can satisfy a user's inclination to suck and nibble.

BRIEF DESCRIPTION OF THE DRAWING(S)

Figure 1:
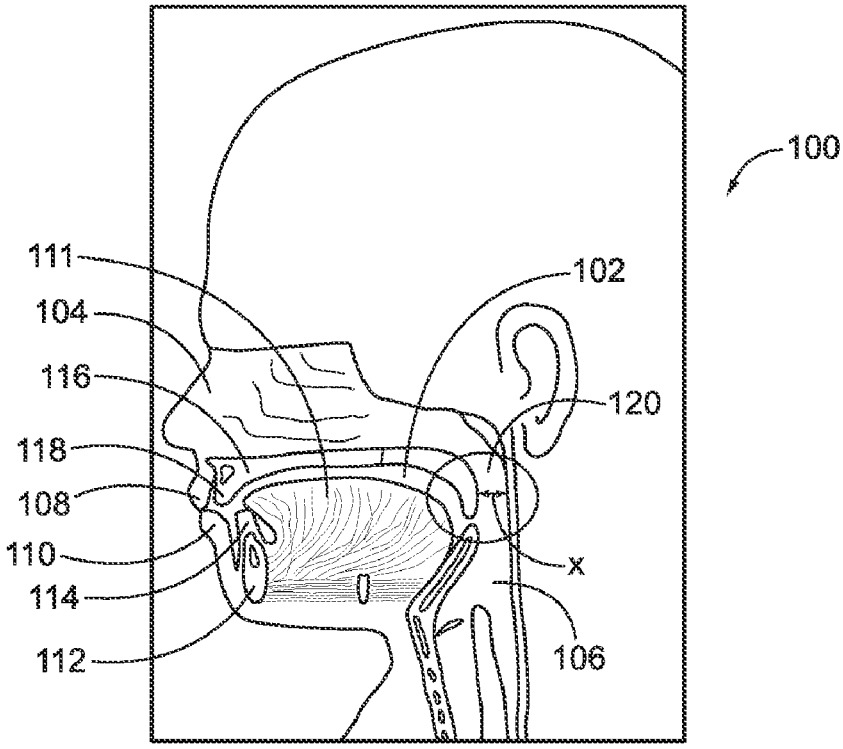
FIG. 1 is a diagram depicting anatomy of a human oral cavity, nasal cavity and throat in a normal resting position.

The foregoing summary, as well as the following detailed description of embodiments of the present invention, will be better understood when read in conjunction with the appended drawings. For the purpose of illustrating the invention, certain embodiments are shown in the drawings. It should be understood, however, that the present invention is not limited to the arrangements and instrumentality shown in the attached drawings.

DETAILED DESCRIPTION OF PREFERRED EMBODIMENT(S)

In the figures like elements are identified with like numerals.

FIG. 1 is a diagram 100 depicting anatomy of a human oral cavity 102, nasal cavity 104 and throat 106 in a normal resting position. Also depicted are upper lip 108, lower lip 110, tongue 111, mandible 112, lower anterior ridge 114, maxilla 116, upper anterior ridge 118, and oropharyngeal airway 120. The distance x across the oropharyngeal airway 120 is also indicated.

Figure 2:
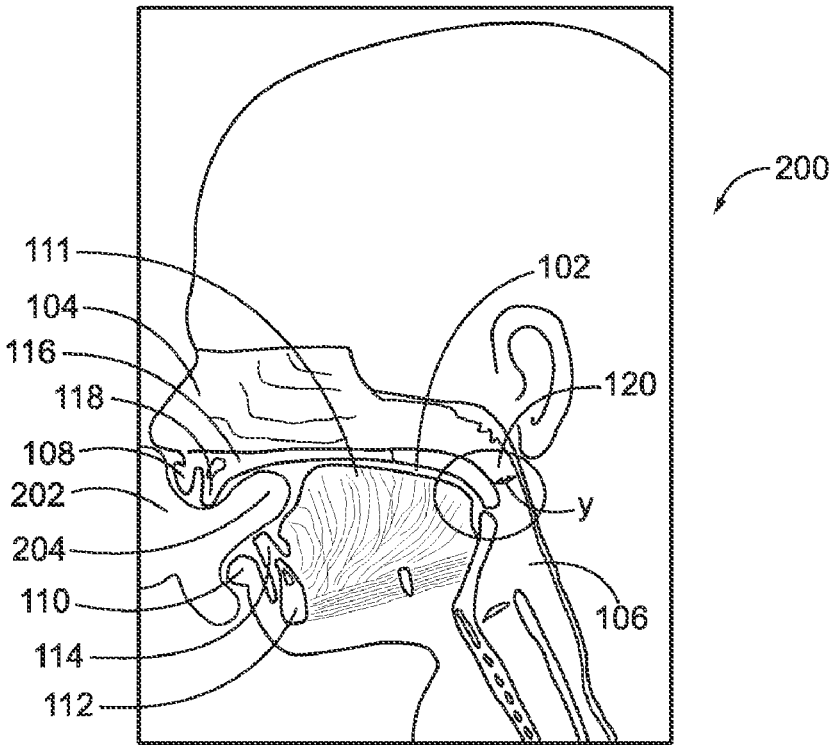
FIG. 2 is a diagram depicting anatomy of a human oral cavity, nasal cavity and throat when a conventional pacifier including a nipple is inserted into the mouth.

FIG. 2 is a diagram 200 depicting anatomy of a human oral cavity 102, nasal cavity 104 and throat 106 when a conventional pacifier 202 including a nipple 204 is inserted into the mouth. Note that the tongue 111 is forced down and toward the throat 106, thereby decreasing the distance y across the oropharyngeal airway 120 and inhibiting mouth and nasal breathing The distance y depicted in FIG. 2 (with conventional pacifier) is less than the distance x depicted in FIG. 1 (when in the normal resting position). Also note in FIG. 2 that the mandible 112 is positioned downward away from the maxilla 116 toward the throat 106, which is not a preferred position in terms of oral development.

It has thus been found that use of conventional pacifiers can inhibit breathing by restricting the oropharyngeal airway, and may not promote preferred oral development and swallowing (as discussed in further detail herein). During waking hours, the negative effects of a pacifier on breathing may be combated by muscles in and around the throat opposing pressure that results from the tongue being forced down and toward the throat. In such instances, a sufficient airway may be maintained despite the tongue being forced down and toward the throat. However, during sleep, and Rapid Eye Movement Sleep (REM) in particular, there is extreme muscle hypotonia (flaccidity), such that the muscles in and around the throat are relaxed and cannot oppose the pressure resulting from the tongue being forced down and toward the throat. In such cases, a sufficient airway may not be maintained. Loss of a sufficient airway during sleep can result in airway collapse, snoring, and/or increased resistance to healthy air flow. Breathing properly when a child is asleep is essential to their well-being, healthy brain function and behavior.

Figure 3:
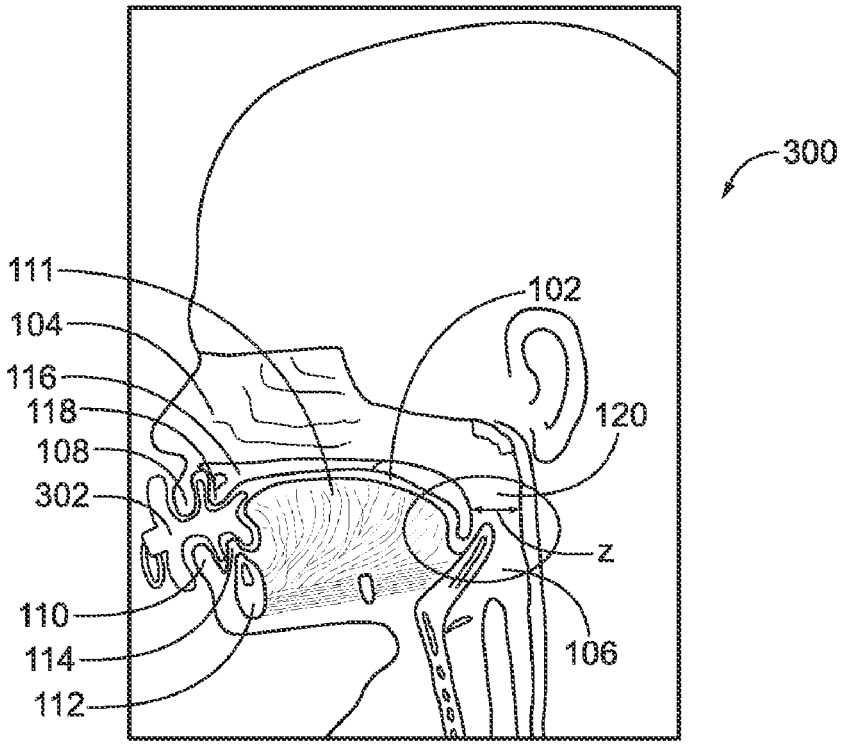
FIG. 3 is a diagram depicting anatomy of a human oral cavity, nasal cavity and throat when a pacifier used in accordance with embodiments of the present technology is inserted into the mouth.

FIG. 3 is a diagram 300 depicting anatomy of a human oral cavity 102, nasal cavity 104 and throat 106 when a pacifier 302 used in accordance with embodiments of the present technology is inserted into the mouth. Note that the tongue 111 is not forced toward the bottom of the mouth and toward the throat 106. Note that the pacifier 302 maintains an anterior position of the mandible 112 substantially directly under the maxilla 118, thereby maintaining a preferred relative positioning in terms of oral development. This can also bring the mandible 112 and tongue 111 (which is attached to the anterior lingual surface of the mandible) forward, away from the throat 106, thereby increasing a distance z across the oropharyngeal airway 120 and allowing improved breathing. The distance z depicted in FIG. 3 (with an inventive pacifier) is greater than the distance x depicted in FIG. 1 (when in the normal resting position) and significantly greater than the distance y in FIG. 2 with the conventional pacifier in the mouth. Embodiments of inventive pacifiers are further discussed in connection with FIGS. 4-13, and some of the advantages of such pacifiers are discussed herein in further detail.

Figure 4:
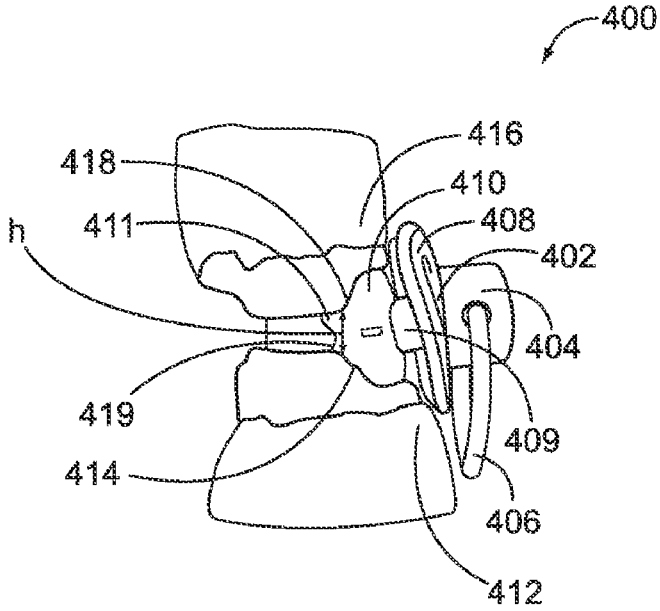
FIG. 4 is a side view depicting anatomy of a human mouth and a pacifier used in accordance with embodiments of the present technology.
Figure 4A:
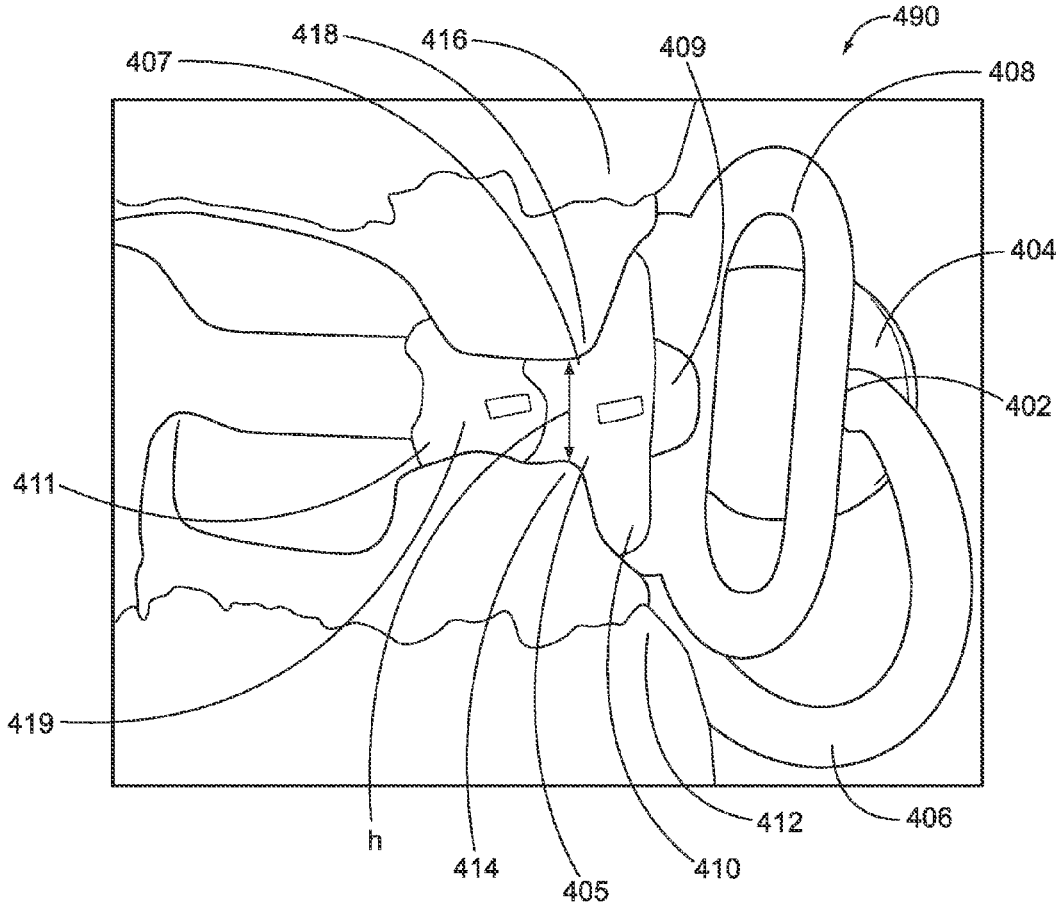
FIG. 4A is a perspective view depicting anatomy of a human mouth and a pacifier used in accordance with embodiments of the present technology.
Figure 5:
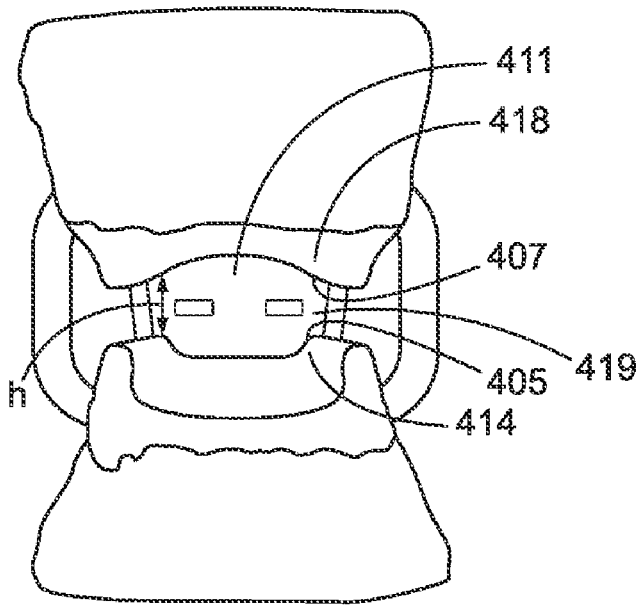
FIG. 5 is a rear view depicting anatomy of a human mouth and a pacifier used in accordance with embodiments of the present technology.

FIG. 4 is a side view 400 depicting anatomy of a human mouth and a pacifier 402 used in accordance with embodiments of the present technology. FIG. 4A is a perspective view 490 depicting the same, and FIG. 5 is a rear view 500 depicting the same. The mouth includes mandible 412, lower anterior ridge 414, maxilla 416 and upper anterior ridge 418. The pacifier 402 includes handle 404, ring 406, shield 408, stem 409, anterior flange 410, posterior flange 411, lower ridge groove 405 (shown in FIG. 5), upper ridge groove 407 (shown in FIG. 5), and tongue groove 419. The upper ridge groove 407 is configured to receive the upper anterior ridge 418 between the posterior flange 411 and the anterior flange 410. The lower ridge groove 405 is configured to receive the lower anterior ridge 414 between the posterior flange 411 and the anterior flange 410. The ridge grooves 405, 407 are configured to maintain a vertical spacing h (an interarch vertical space) between the upper anterior ridge 418 and the lower anterior ridge 414.

In certain embodiments, the ridge grooves 405, 407 can be configured to maintain a vertical spacing h between the upper anterior ridge 418 and the lower anterior ridge 414 of about 4 millimeters. Such embodiments may be configured to accommodate children between 0 and about 6 months of age.

In certain embodiments, the ridge grooves 405, 407 can be configured to maintain a vertical spacing h between the upper anterior ridge 418 and the lower anterior ridge 414 of about 3 millimeters. In such embodiments, the upper ridge groove 407 can be made deeper in order to decrease the vertical spacing between the ridge grooves 405, 407. Such embodiments may be configured to accommodate children between about 6 months and about 12 months of age. Such embodiments may also include a relatively larger shield and anterior flange in order to accommodate mouth size of a child between about 6 months and about 12 months of age. During this timeframe, the child's first deciduous teeth may be erupting, and a relatively smaller spacing between the grooves can accommodate such teeth.

In certain embodiments, the ridge grooves 405, 407 can be configured to maintain a vertical spacing h between the upper anterior ridge 418 and the lower anterior ridge 414 of about 2 millimeters. In such embodiments, the upper ridge groove 407 can be made deeper in order to decrease the vertical spacing between the ridge grooves 405, 407. Such embodiments may be configured to accommodate children between about 12 months and about 24 months of age. Such embodiments may also include a relatively larger shield and anterior flange in order to accommodate mouth size of a child between about 12 months and about 24 months of age. During this timeframe, the child's anterior teeth have erupted, and a relatively smaller spacing between the grooves can accommodate such teeth.

Figure 6:
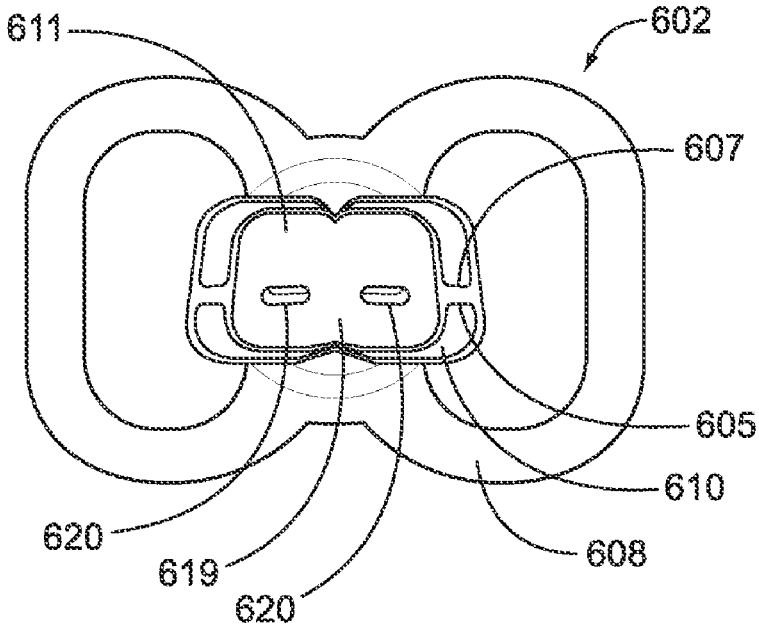
FIG. 6 is a rear view of a pacifier used in accordance with embodiments of the present technology.
Figure 6A:
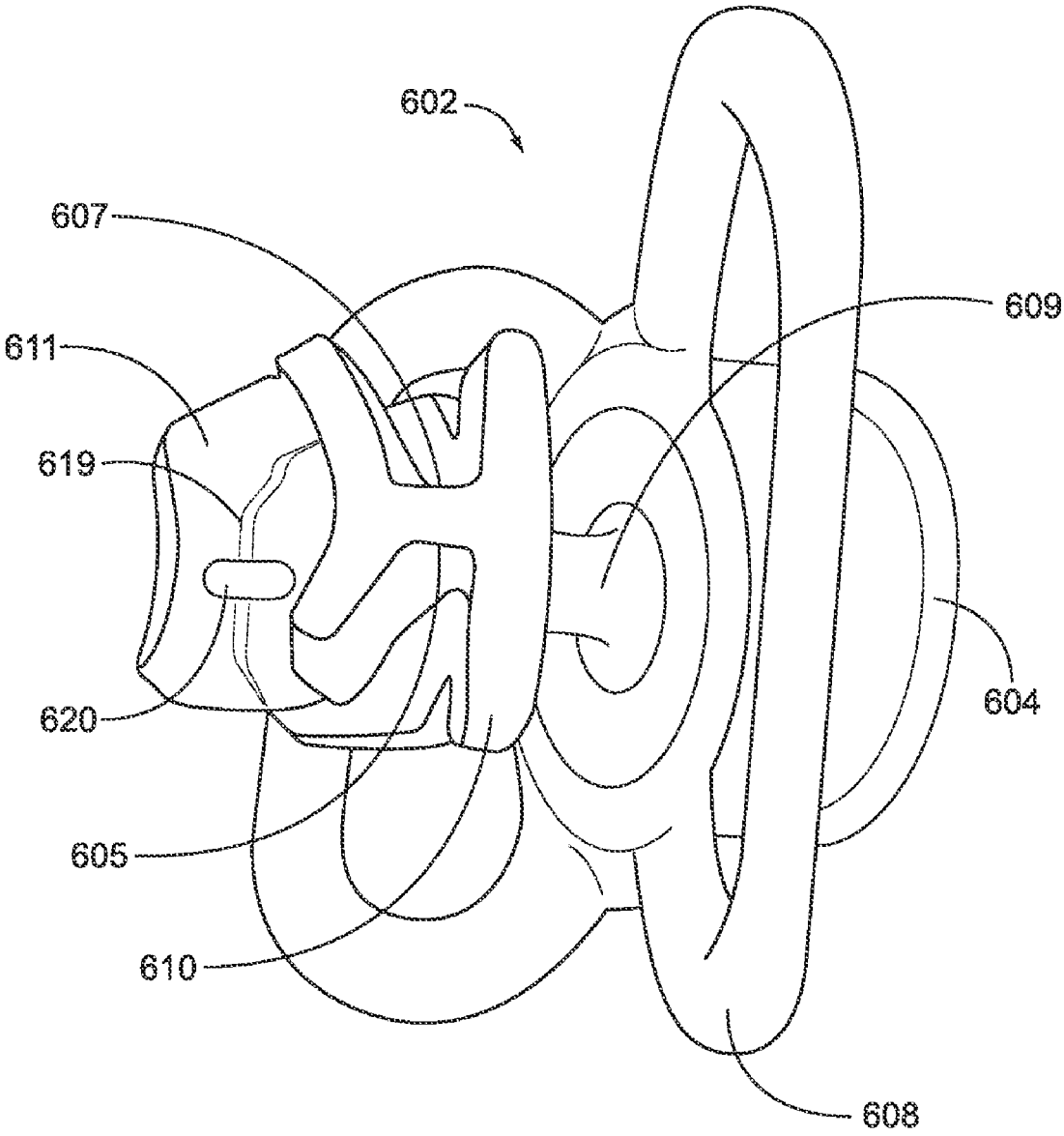
FIG. 6A is a perspective view of the pacifier depicted in FIG. 6.
Figure 7:
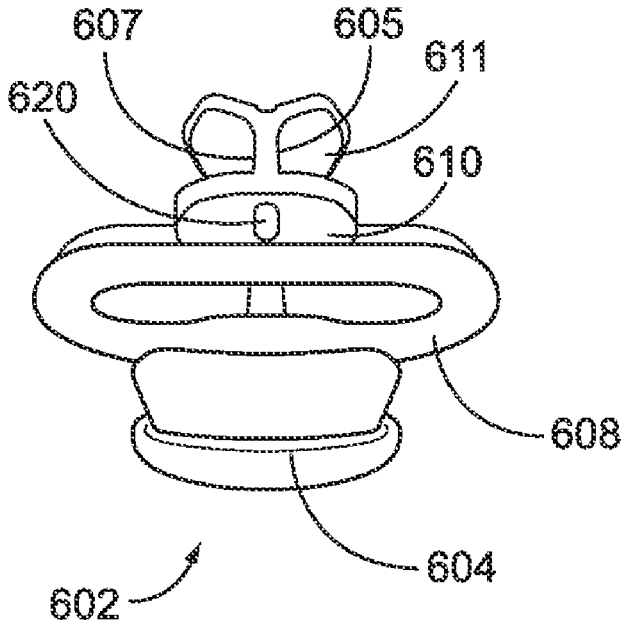
FIG. 7 is a side view of the pacifier depicted in FIG. 6.

FIG. 6 is a rear view of a pacifier 602 used in accordance with embodiments of the present technology. FIGS. 6A-9 depict various views of the pacifier 602. The pacifier 602 includes handle 604, shield 608, stem 609 (shown in FIGS. 6A, 8 and 9), anterior flange 610, posterior flange 611, lower ridge groove 605, upper ridge groove 607, tongue groove 619 (shown in FIG. 6), and air holes 620 (shown in FIG. 6). The upper ridge groove 607 is configured to receive the upper anterior ridge between the posterior flange 611 and the anterior flange 610. The lower ridge groove 605 is configured to receive the lower anterior ridge between the posterior flange 611 and the anterior flange 610. The ridge grooves 605, 607 are configured to maintain a vertical spacing between the upper anterior ridge and the lower anterior ridge. When a user's upper anterior ridge is in the upper ridge groove 607, the flanges 610, 611 extend substantially vertically upward over the front and back edges of the upper anterior ridge. Likewise, when a user's lower anterior ridge is in the lower ridge groove 605, the flanges 610, 611 extend substantially vertically downward over the front and back edges of the lower anterior ridge.

The tongue groove 619 is configured to receive the tongue in a near-normal position. The tongue groove 619 is concave and runs the width of the posterior flange. A pacifier user that positions the tip of the tongue in the tongue groove 619 may reflexively place the remainder of the tongue against the roof of the mouth, which position can aid in increasing the size of the oropharyngeal airway and facilitate a correct physiologic swallow.

Figure 14:
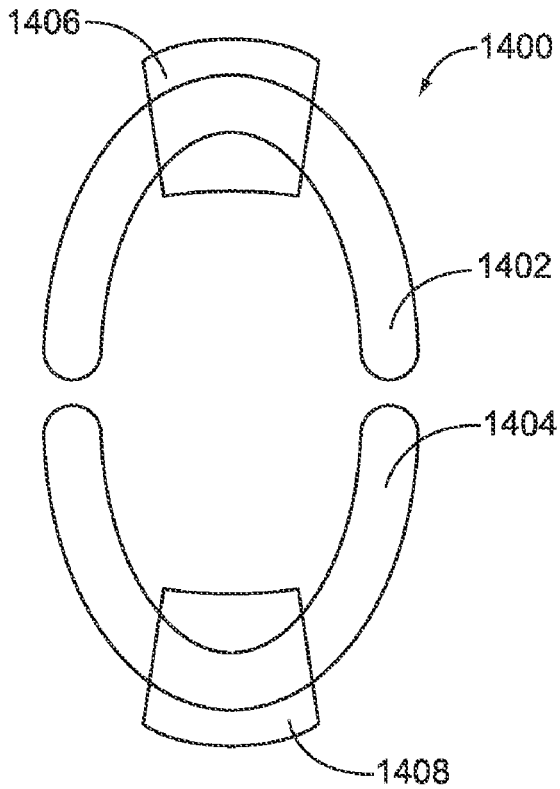
FIG. 14 is a diagram depicting an individual's gums.

Anterior flange 610 and posterior flange 611 are configured to span only across the user's anterior ridges, and not to span across the user's posterior ridges. For example, FIG. 14 is a diagram 1400 depicting a user's gums. The gums include an upper ridge 1402 and a lower ridge 1404. An approximation of a user's upper anterior ridge is indicated by 1406, and an approximation of a user's lower anterior ridge is indicated by 1408. The remaining ridge area may be considered posterior. In certain embodiments, spanning only across the user's anterior ridges, and not to across the user's posterior ridges, can avoid unwanted manipulation of the tongue down and toward the throat. It has been found that spanning across the user's posterior ridges, restricts space in the mouth for the tongue and may cause unwanted positioning of the tongue down and toward the throat.

As another method of approximation, anterior flange 610 and posterior flange 611 can be configured to span from about a user's right cuspid area to about the user's left cuspid area. The cuspid areas are the areas where permanent canine teeth will generally be located in the mouth (once they come in). In certain embodiments, spanning from about cuspid area to about cuspid area can avoid unwanted manipulation of the tongue down and toward the throat. It has been found that spanning beyond the cuspid areas, for example, to the molar areas may increase unwanted manipulation of the tongue down and toward the throat.

In certain embodiments, the anterior flange 610 and the posterior flange 611 have rounded edges. Rounded edges can provide improved comfort and reduce irritation to the tongue and/or lips on insertion and removal. In certain embodiments, the anterior flange 610 is larger than the posterior flange 611 in both horizontal and vertical measurement. A smaller posterior flange 611 may make it easier to insert and remove the pacifier. In certain embodiments, the anterior flange 610 can provide for improved retention of the pacifier 602 in the mouth. For example, the location of the anterior flange 610 between the lips and upper and lower anterior ridges can aid in maintaining the pacifier 602 in the mouth more securely.

The anterior flange 610 includes frenum relief grooves 621 (shown in FIGS. 8 and 9) positioned at the top and bottom and toward the center of the anterior flange 610. In certain embodiments, frenum relief grooves can be v-shaped and can provide improved comfort.

The posterior flange 611 includes incisive papilla/lingual frenum relief grooves 622 (shown in FIGS. 8 and 9) positioned at the top and bottom and toward the center of the anterior flange 610. In certain embodiments, frenum relief grooves can be v-shaped and can provide improved comfort.

The air holes 620 pass through the posterior flange 611, through the arch space between the posterior flange 611 and the anterior flange 610 (the arch space separates the lower and upper grooves 605, 607), and through the anterior flange 610. The air holes 620 are positioned on either side of stem 609. In certain embodiments, the air holes can be about 1 millimeter vertically by about 3 millimeters horizontally. In certain embodiments, the air holes can provide for improved breathing if the pacifier 602 is aspirated or for general mouth breathing.

As shown in FIG. 6, shield 608 can comprise an open construction, thereby allowing air to pass through, while inhibiting the shield (and the entire pacifier) from entering a user's mouth. Such a shield can allow sufficient airflow to allow a user of the pacifier to breathe through his or her mouth.

Figure 8:
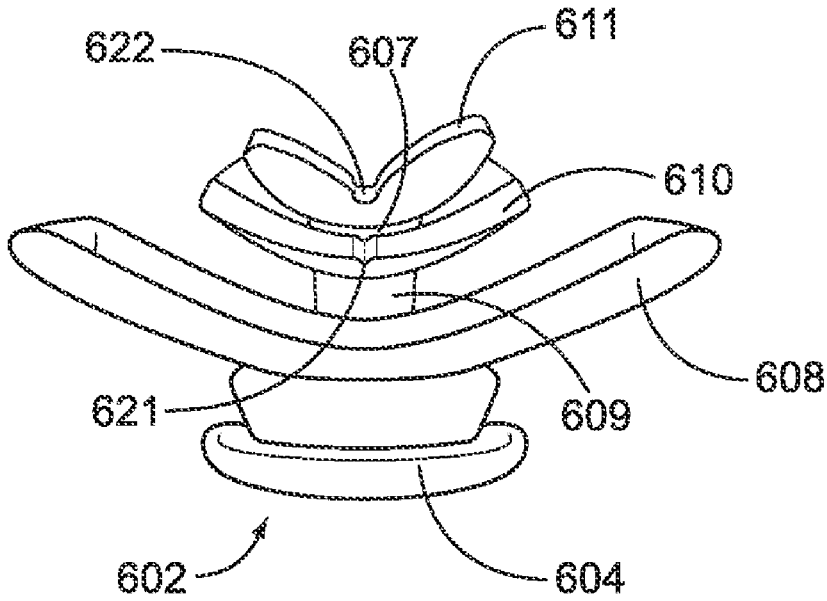
FIG. 8 is a top view of the pacifier depicted in FIG. 6.
Figure 9:
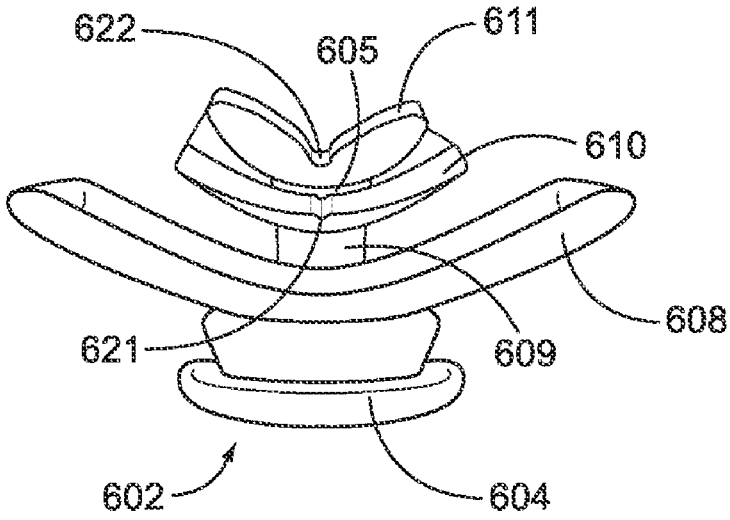
FIG. 9 is a bottom view of the pacifier depicted in FIG. 6.

As shown in FIGS. 8 and 9, the pacifier 602 can be symmetrical such that it can be inserted into a user's mouth with a user's upper anterior ridge in the upper ridge groove 607 and the user's lower anterior ridge in the lower ridge groove 605 or vice versa, with the user's upper anterior ridge in the lower ridge groove 605 and the user's lower anterior ridge in the upper ridge groove 607.

As shown in FIGS. 8 and 9, stem 609 can provide spacing for the lips between the anterior flange 610 and the shield 608. In certain embodiments, the pacifier 602 can also include a ring, such as the ring 406 shown in FIG. 4. In certain embodiments, the flange and stem portions of the pacifier 602 can comprise latex rubber, medical grade silicone, and/or another suitable material. In certain embodiments, the shield, handle and ring can comprise thermoplastic acrylic and/or another suitable material.

Figure 10:
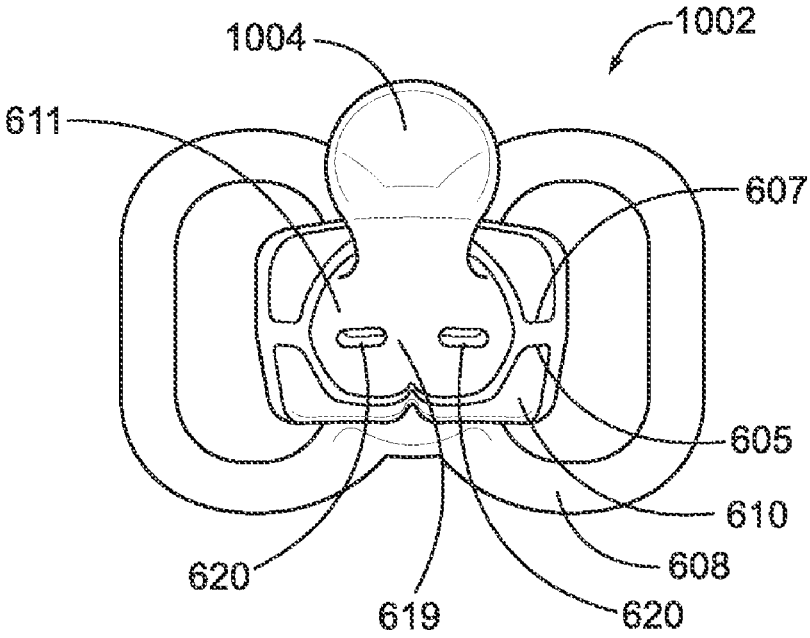
FIG. 10 is a rear view of a pacifier used in accordance with embodiments of the present technology.
Figure 11:
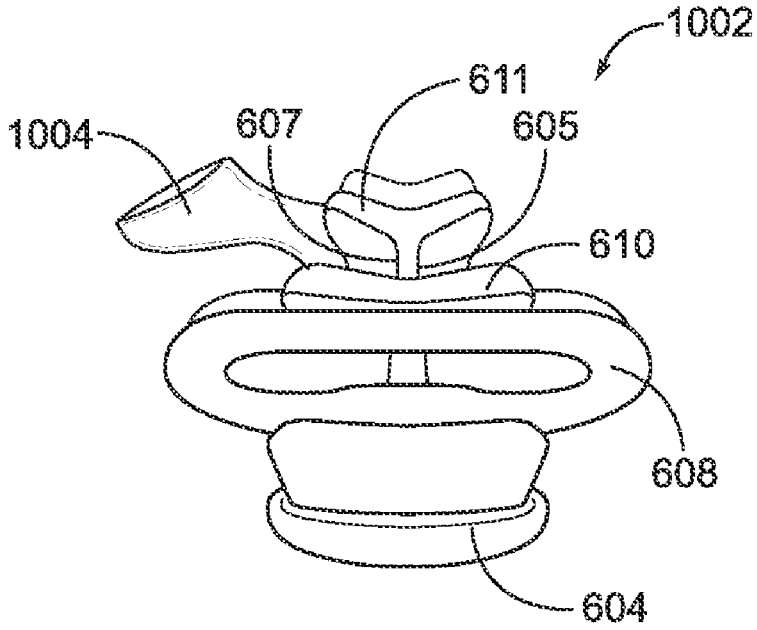
FIG. 11 is a side view of the pacifier depicted in FIG. 10.
Figure 12:
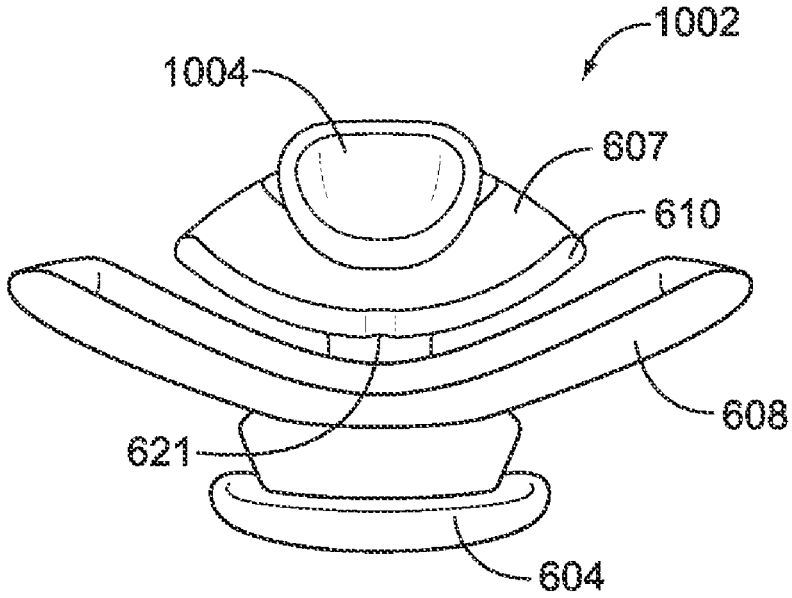
FIG. 12 is a top view of the pacifier depicted in FIG. 10.
Figure 13:
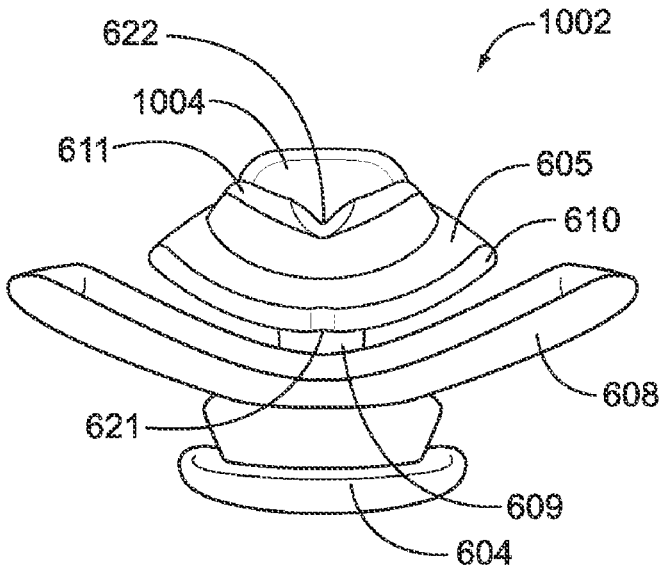
FIG. 13 is a bottom view of the pacifier depicted in FIG. 10.

FIG. 10 is a rear view of a pacifier 1002 used in accordance with embodiments of the present technology. FIGS. 11-13 depict various views of the pacifier 1002. The pacifier 1002 is identical to the pacifier 602 shown and described in connection with FIGS. 6-9, except that it further includes nipple 1004 projecting substantially vertically from the posterior flange 611. Nipple 1004 is shaped as a flattened oval compared to conventional nipples. Also, rather than projecting horizontally, nipple 1004 projects substantially vertically. Also, nipple 1004 can be about a third smaller than conventional nipples, thereby taking up less space in the mouth. When the pacifier 1002 is held in the mouth (such that the upper anterior ridge is received in the upper ridge groove 607), the nipple 1004 will be forced through contact with the roof of the mouth into a substantially horizontal position and maintain contact with the roof of the mouth. In certain embodiments, such nipple positioning can stimulate proper palatal growth, and the pacifier can also bring the mandible and maxilla into preferred relative positioning.

Certain embodiments of the inventive pacifiers described herein can provide a user with a device for non-nutritive sucking and nibbling and also provide enhanced airway patency and preferred oral development. For example, embodiments can maintain the mandible in a forward position (away from the throat) and more vertically open (further from the maxilla) than a typical rest position. The forward position can also bring the tongue, which is attached to the anterior lingual surface of the mandible, forward, thereby increasing the size of the airway in the area of the throat.

During nighttime use, embodiments can allow for enhanced airway patency that is generally restricted by conventional pacifiers. Rather than spitting out the pacifier, which is often the case with conventional pacifiers, the user can simply separate the lips for oral breathing Embodiments can help to prevent and resolve oral airflow resistance, snoring and apnea, which conditions may be aggravated by use of conventional pacifiers that force the tongue down toward the bottom of the mouth and back toward the throat. While embodiments described herein are particularly beneficial for nighttime use, they can also be used during the day for non-nutritive sucking and nibbling.

Certain embodiments of the inventive pacifiers described herein can stimulate healthy jaw growth and development. For example, in certain pediatric diseases of hypotrophic mandibular growth, the magnitude of mandibular advancement achieved by embodiments of the present inventions was previously accomplished by techniques of surgical distraction and surgical repair. However, if a child can get his or her mandible and maxilla into the upper and lower ridge grooves of the inventive pacifiers described herein, the pacifiers can stimulate corrective growth patterns in children with mandibular hypotrophy. Further, the mandible-to-maxilla positioning of upper anterior ridge or teeth substantially directly above the lower anterior ridge or teeth in embodiments of the inventive pacifiers is a position that facilitates healthy facial growth and development in all children.

Certain embodiments of the inventive pacifiers described herein can facilitate a correct physiological swallow. For example, the tongue groove provides a comfortable place for positioning the tip of the tongue. The sucking reflex action of a pacifier user and the suction generated can maintain the tip of the tongue in the anterior tongue groove, and this sucking also positions the top of the tongue against the roof of the mouth. This is the proper position for nose breathing and the position for the correct physiological swallow of saliva during sleep and correct swallow when awake.

While particular elements, embodiments and applications of the present invention have been shown and described, it will be understood that the invention is not limited thereto since modifications can be made by those skilled in the art without departing from the scope of the present disclosure, particularly in light of the foregoing teachings.

What is claimed is:

1. A pacifier for use in user's oral cavity and in relation to portions of a user's anatomy including an upper ridge, a lower ridge, a maxilla, a mandible, a tongue including a tip, a roof of the mouth, a right cuspid area, a left cuspid area, and a throat, wherein the pacifier comprises:

a spacing portion configured to receive the upper ridge and the lower ridge;

a posterior flange positioned at a posterior end of the spacing portion and including a tongue groove configured to receive the tip of the tongue while the tongue is in a near-normal position;

a projection portion positioned on an upper side of the posterior flange and arranged to project from the posterior flange, above the tongue, and to the roof of the mouth;

wherein the posterior flange is configured to:

not push the tip of the tongue posteriorly, span only from the right cuspid area to the left cuspid area, maintain the lower ridge in a forward position to draw the mandible away from the throat, and maintain the upper ridge substantially and directly above the lower ridge; and wherein, from the perspective of the rear of the pacifier, the posterior flange is concave along a horizontal dimension and concave along a vertical dimension.

2. The pacifier of claim 1, wherein the posterior flange is configured to maintain the upper ridge substantially and directly above the lower ridge.

3. The pacifier of claim 1, wherein the spacing portion comprises a thickness to maintain a minimum vertical spacing between the upper ridge and the lower ridge.

4. The pacifier of claim 3, wherein the pacifier is configured for a child between the ages of 0 months and 6 months, and wherein the thickness is about 4 millimeters.

5. The pacifier of claim 3, wherein the pacifier is configured for a child between the ages of 6 months and 12 months, and wherein the thickness is about 3 millimeters.

6. The pacifier of claim 3, wherein the pacifier is configured for a child between the ages of 12 months and 24 months, and wherein the thickness is about 2 millimeters.

7. The pacifier of claim 1, further comprising a shield configured to:

allow air to pass through the shield, and inhibit the shield from entering the oral cavity.

8. The pacifier of claim 1, wherein the posterior flange includes: a first papilla/lingual frenum relief groove positioned at a top and toward a center of the posterior flange; and a second papilla/lingual frenum relief groove positioned at a bottom and toward the center of the posterior flange.

9. The pacifier of claim 1, wherein the posterior flange comprises rounded edges.

10. The pacifier of claim 1, wherein the posterior flange comprises an air hole.

11. The pacifier of claim 10, wherein the air hole is about 1 millimeter high and about 3 millimeters wide.

* * * * *